US006360752B1

(12) United States Patent
Chang

(10) Patent No.: US 6,360,752 B1
(45) Date of Patent: Mar. 26, 2002

(54) PERM HAIRGRIP

(75) Inventor: Pi-Hsien Chang, Chang Hwa Shein (TW)

(73) Assignee: Chia Hsin Cosmetics Co., Ltd., Shihtze (TW)

( * ) Notice: Subject to any disclaimer, the term of this patent is extended or adjusted under 35 U.S.C. 154(b) by 0 days.

(21) Appl. No.: 09/865,740

(22) Filed: May 25, 2001

(51) Int. Cl.[7] ..... A45D 8/20; A45D 8/22; A45D 2/24

(52) U.S. Cl. ..... 132/277; 132/278; 132/259; 132/260

(58) Field of Search ..... 132/277, 276, 132/278, 224, 279, 273, 245, 250, 259, 260, 263; 24/455, 571, 570

(56) References Cited

U.S. PATENT DOCUMENTS 5,195,216 A * 3/1993 Ishii ..... 24/18
5,740,820 A * 4/1998 Stern ..... 132/249
6,041,792 A * 3/2000 Kennedy ..... 132/275

* cited by examiner

*Primary Examiner*—John J. Wilson
*Assistant Examiner*—Robyn Kieu Doan
(74) *Attorney, Agent, or Firm*—Alan Kamrath; Rider, Bennett, Egan & Arundel, LLP

(57) ABSTRACT

A perm hairgrip has a first clamp device, a second clamp device, a first adhesive layer, a second adhesive layer, a first ceramic plate, a second ceramic plate, a pivot pin, and a tension spring. The first clamp device has a first holding plate. The second clamp device has a second holding plate. The first adhesive layer is disposed on the first holding plate. The second adhesive layer is disposed on the second holding plate. The first ceramic plate is disposed on the first adhesive layer. The second ceramic plate is disposed on the second adhesive layer. The pivot pin fastens the first clamp device and the second clamp device together.

2 Claims, 4 Drawing Sheets

PERM HAIRGRIP

BACKGROUND OF THE INVENTION

The present invention relates to a perm hairgrip. More particularly, the present invention relates to a perm hairgrip which has two ceramic plates.

A conventional perm hairgrip dissipates heat fast. It takes more than one hour to perform a perm treatment. Therefore, a permanent wave of hair will be damaged after a long period of perm treatment.

SUMMARY OF THE INVENTION

An object of the present invention is to provide a perm hairgrip which has two ceramic plates to focus heat fast.

Another object of the present invention is to provide a perm hairgrip which has two ceramic plates to dissipate heat slowly.

Another object of the present invention is to provide a perm hairgrip in order to perform a perm treatment quickly.

Accordingly, a perm hairgrip comprises a first clamp device, a second clamp device, a first adhesive layer, a second adhesive layer, a first ceramic plate, a second ceramic plate, a pivot pin, and a tension spring. The first clamp device has a first holding plate. The second clamp device has a second holding plate. The first adhesive layer is disposed on the first holding plate. The second adhesive layer is disposed on the second holding plate. The first ceramic plate is disposed on the first adhesive layer. The second ceramic plate is disposed on the second adhesive layer. The pivot pin passes through the tension spring to fasten the first clamp device and the second clamp device together.

DETAILED DESCRIPTION OF THE INVENTION

Figure 1:
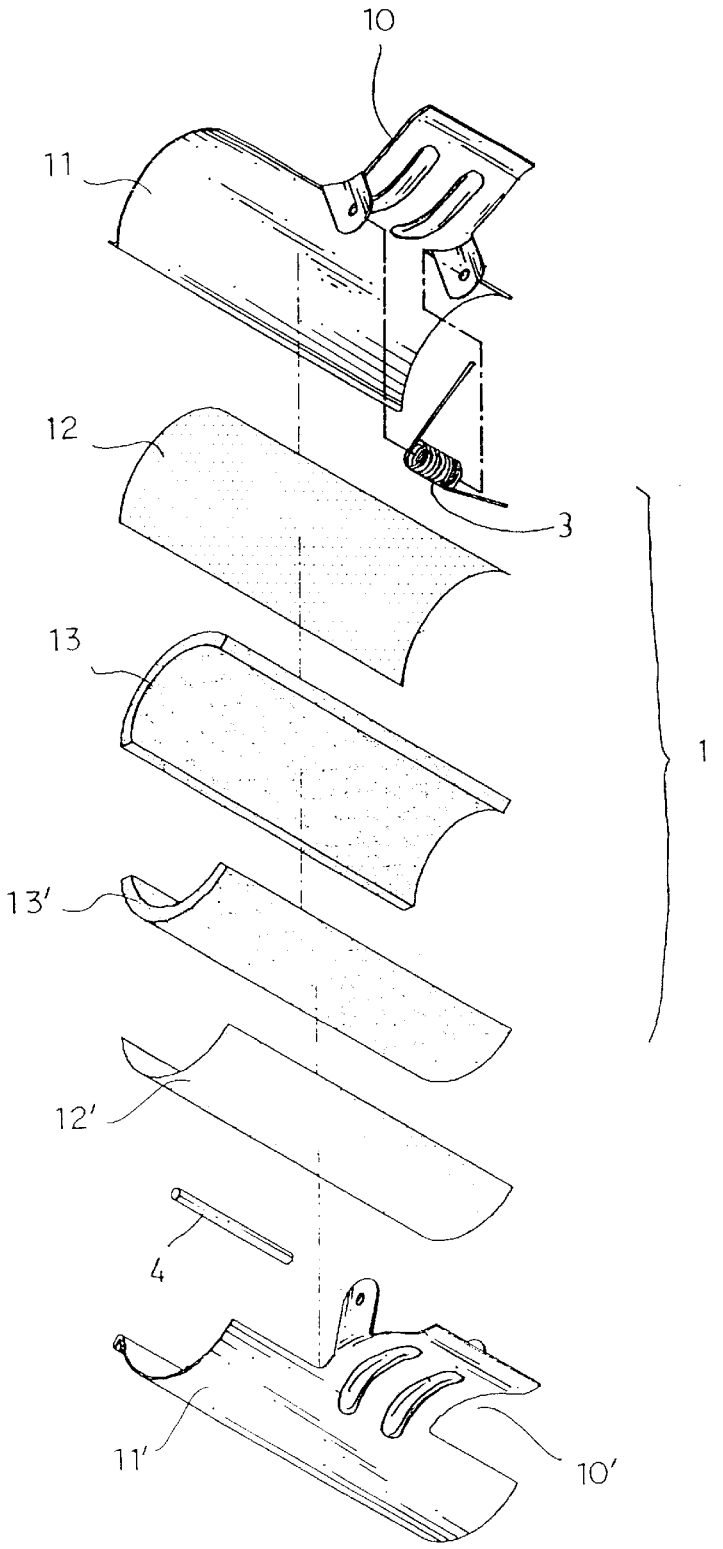
FIG. 1 is a perspective exploded view of a perm hairgrip of a preferred embodiment in accordance with the present invention.
Figure 2:
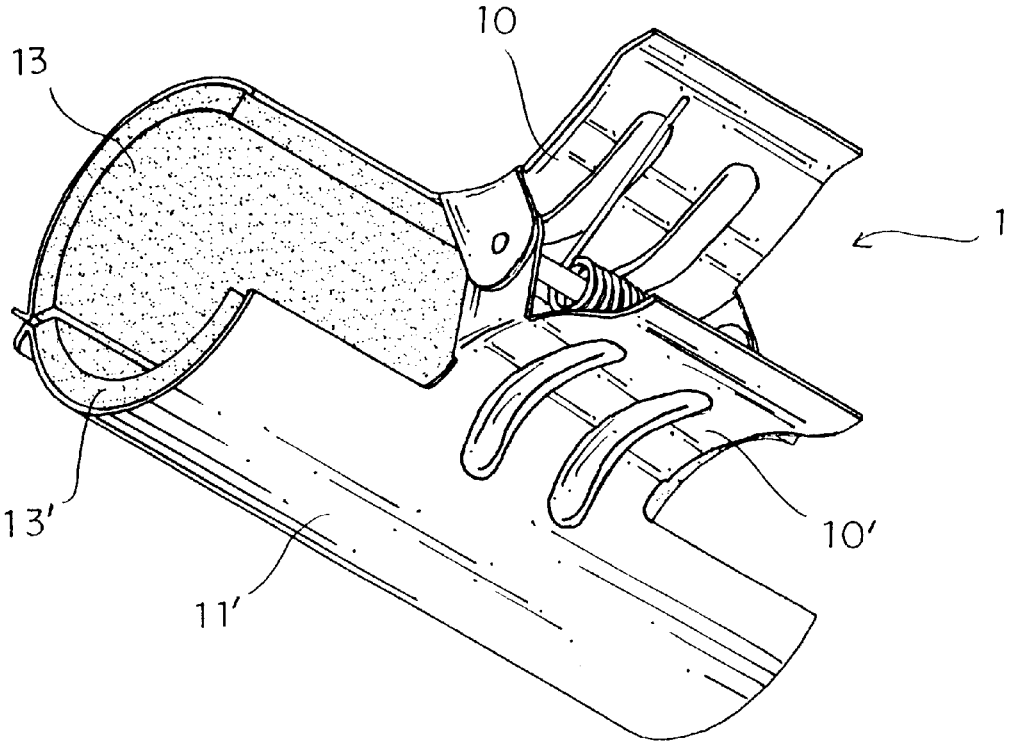
FIG. 2 is a perspective assembly view of a perm hairgrip of a preferred embodiment in accordance with the present invention.

Referring to FIGS. 1 and 2 first, a perm hairgrip 1 comprises a first clamp device 10, a second clamp device 10', a first adhesive layer 12, a second adhesive layer 12', a first ceramic plate 13, a second ceramic plate 13', a pivot pin 4, and a tension spring 3.

The first clamp device 10 has a first holding plate 11.

The second clamp device 10' has a second holding plate 11'.

The first adhesive layer 12 is disposed on the first holding plate 11.

The second adhesive layer 12' is disposed on the second holding plate 11'.

The first ceramic plate 13 is disposed on the first adhesive layer 12.

The second ceramic plate 13' is disposed on the second adhesive layer 12'.

The pivot pin 4 passes through the tension spring 3 to fasten the first clamp device 10 and the second clamp device 10' together.

It is an option to pretreat the first ceramic plate 13 and the second ceramic plate 13' by far-infrared rays in order to protect a hair.

Figure 3:
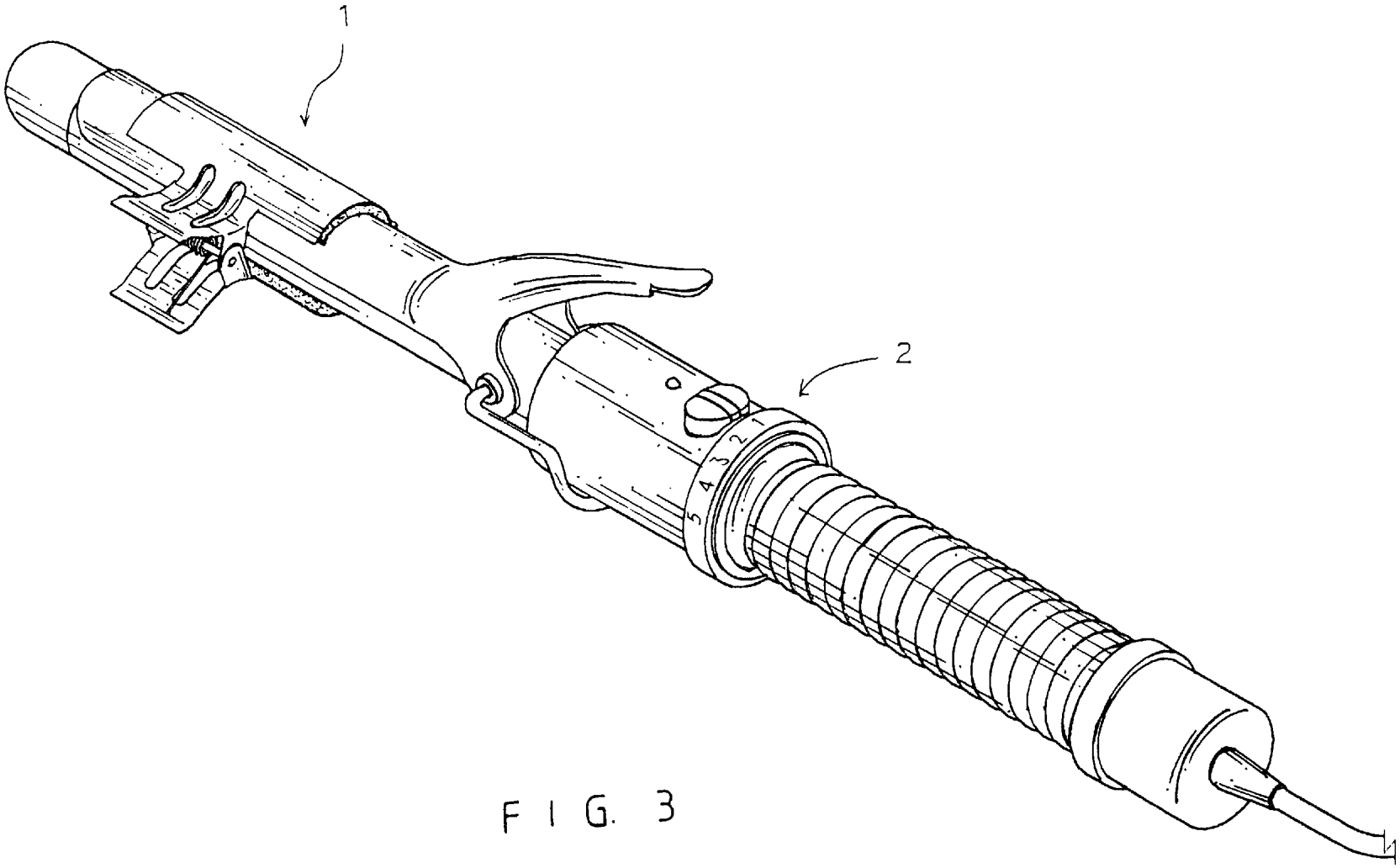
FIG. 3 is a schematic view illustrating a perm hairgrip of a preferred embodiment disposed on an electrothermal hair curler.

Referring to FIG. 3, the perm hairgrip 1 is disposed on an electrothermal hair curler 2. The electrothermal hair curler 2 preheats the perm hairgrip 1.

Figure 4:
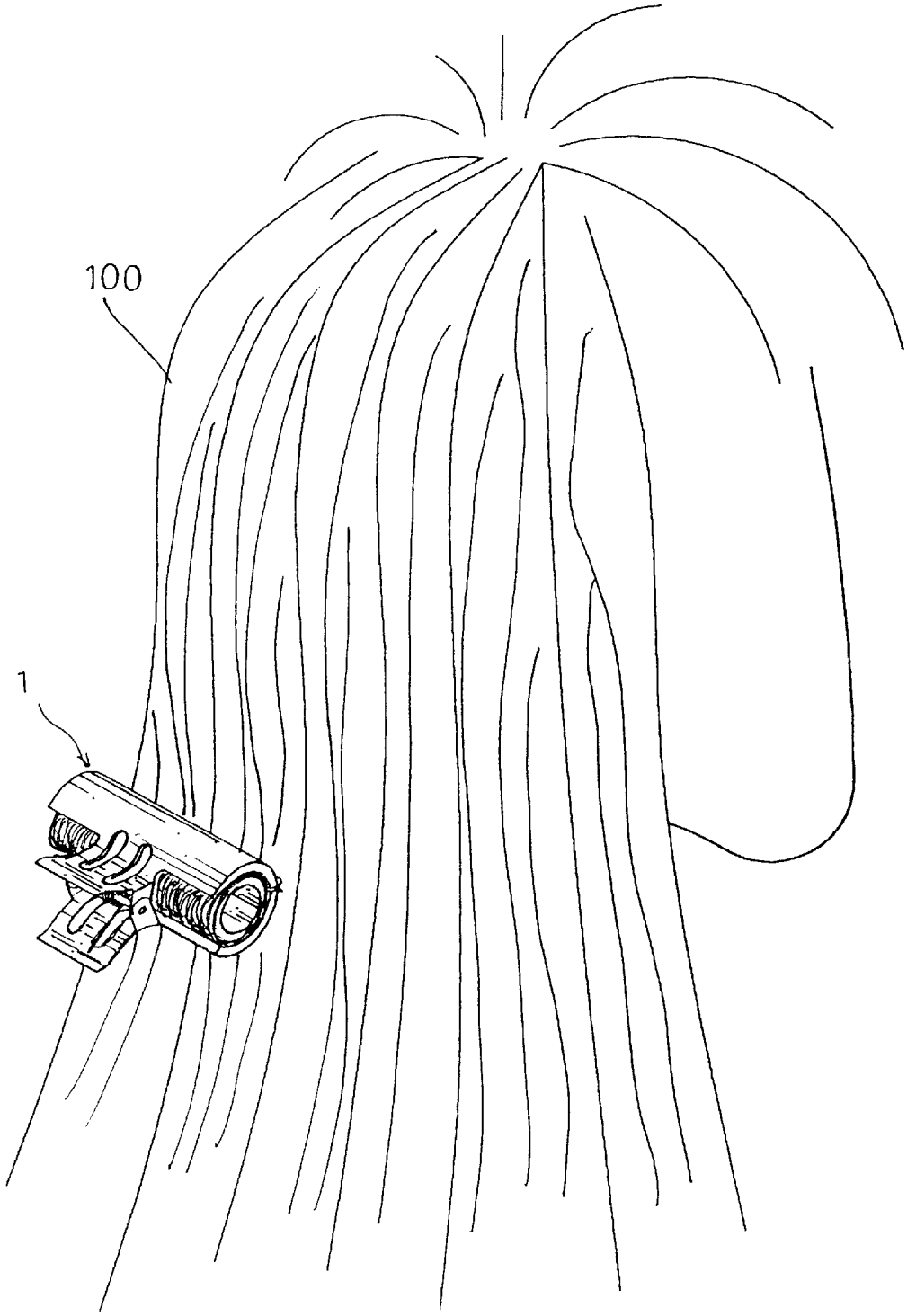
FIG. 4 is a schematic view illustrating a perm hairgrip of a preferred embodiment disposed on a hair.

Referring to FIG. 4, the preheated perm hairgrip 1 is disposed on a hair 100.

The present invention has the following advantages. The first ceramic plate 13 and the second ceramic plate 13' focus heat fast. The first ceramic plate 13 and the second ceramic plate 13' dissipate heat slowly. The perm hairgrip 1 performs a perm treatment quickly.

The present invention is not limited to the above embodiment but various modification thereof may be made. Furthermore, various changes in form and detail may be made without departing from the scope of the present invention.

I claim:

1. A perm hairgrip comprises:

a first clamp device, a second clamp device, a first adhesive layer, a second adhesive layer, a first ceramic plate, a second ceramic plate, a pivot pin, and a tension spring, the first clamp device having a first holding plate, the second clamp device having a second holding plate, the first adhesive layer disposed on the first holding plate, the second adhesive layer disposed on the second holding plate, the first ceramic plate disposed on the first adhesive layer, the second ceramic plate disposed on the second adhesive layer, and the pivot pin passing through the tension spring to fasten the first clamp device and the second clamp device together.

2. The perm hairgrip as claimed in claim 1, wherein the first ceramic plate and the second ceramic plate are pretreated by far-infrared rays.

* * * * *